US006036330A

United States Patent [19]

Sanguedolce

[11] Patent Number: 6,036,330

[45] Date of Patent: Mar. 14, 2000

[54] LIGHT SWITCH EXTENDER

[76] Inventor: Michael Sanguedolce, 154 Clinton Ave., Mastic, N.Y. 11950

[21] Appl. No.: 09/010,401

[22] Filed: Jan. 21, 1998

[51] Int. Cl.[7] ..... F21V 33/00; H01H 15/24

[52] U.S. Cl. ..... 362/95; 362/399; 200/330; 200/331

[58] Field of Search ..... 362/95, 253, 399; 200/330, 331

[56] References Cited

U.S. PATENT DOCUMENTS

| | | | |
|---|---|---|---|
| 2,389,220 | 11/1945 | Tredeau | 200/331 |
| 2,668,456 | 2/1954 | Meistrell | 200/331 X |
| 3,590,648 | 7/1971 | Gorman | 200/331 X |
| 3,839,615 | 10/1974 | Bradford | 200/331 |
| 3,892,935 | 7/1975 | Patterson | 200/331 |
| 4,105,884 | 8/1978 | Damsky | 200/331 |
| 4,295,026 | 10/1981 | Williams et al. | 200/331 |
| 4,454,401 | 6/1984 | Powis, Jr. | 200/331 |
| 4,914,265 | 4/1990 | Mongeau | 200/331 |
| 5,577,602 | 11/1996 | Conner et al. | 200/331 |

*Primary Examiner*—Laura K. Tso
*Attorney, Agent, or Firm*—Michael I Kroll

[57] ABSTRACT

A light switch extender (10) comprising an elongate actuator (12). An assembly (14) is for vertically mounting the elongate actuator (12) in a sliding manner to a switch plate (16) of a light switch (18) located in a junction box (20) in a wall (22). The elongate actuator (12) engages a lever (24) of the light switch (18) and extends downwardly therefrom. A small child (26) who normally cannot reach the lever (24) of the light switch (18) can now operate the lever (24) of the light switch (18) between an on and off position, by sliding the elongate actuator (12) up and down.

16 Claims, 4 Drawing Sheets

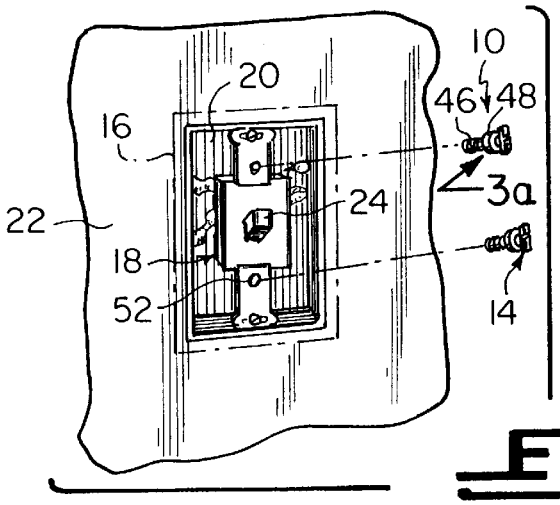
Fig. 3
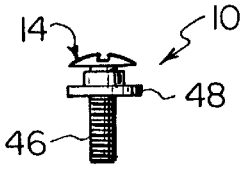
Fig. 3a
Fig. 4
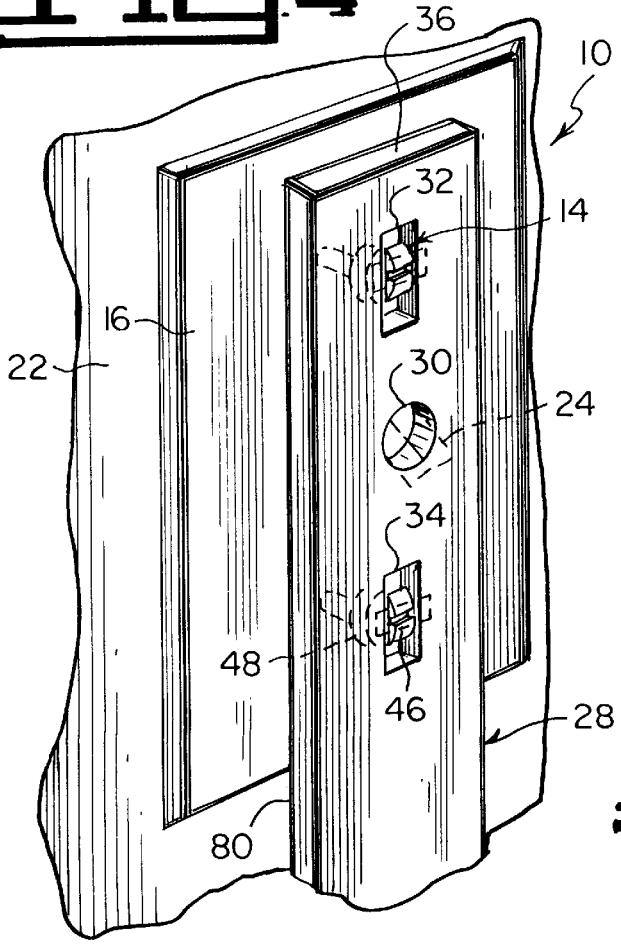
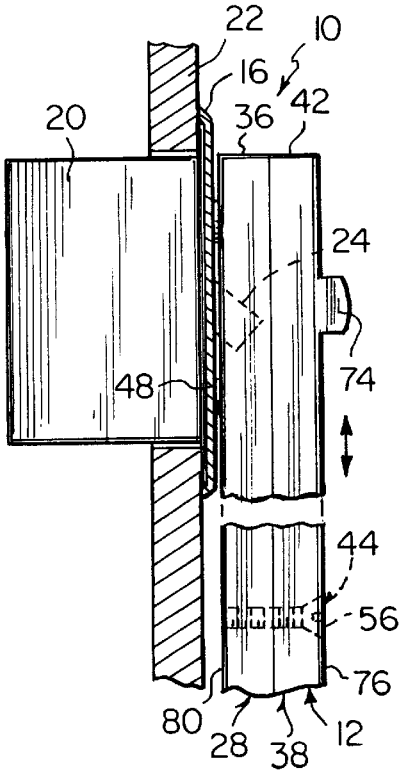
Fig. 5

36
10
32
30
34
28
84
7
82
86
78
68
60
62
58

36
10
32
30
34
28
84
82
86
80
78
68
60
62
58

42
40
10
74
76
38
88
9
90
70
66
64

42
10
40
74
76
38
90
88
70
66
64

LIGHT SWITCH EXTENDER

BACKGROUND OF THE INVENTION

1. Field of the Invention

The instant invention relates generally to electrical wall switch installations and more specifically it relates to a light switch extender. The light switch extender is attached in a sliding manner to a switch plate, so that a small child can safely and conveniently operate the lever of a light switch. The light switch extender has dual mounting positions to allow an additional length to be added thereto for the child's reach. It can be used in a bedroom, bathroom or any other room a child might want to go in.

2. Description of the Prior Art

Numerous wall switch installations have been provided in prior art. For example, U.S. Pat. No. 4,105,884 to Damsky; U.S. Pat. No. 4,454,401 to Powis, Jr.; U.S. Pat. No. 4,914,265 to Mongeau and U.S. Pat. No. 5,577,602 to Conner et al. all are illustrative of such prior art. While these units may be suitable for the particular purpose to which they address, they would not be as suitable for the purposes of the present invention as heretofore described.

DAMSKY, ARNOLD M.

ELECTRICAL TOGGLE SWITCH LEVER EXTENDER

U.S. Pat. No. 4,105,884

A substitute toggle switch cover plate has an elongated opening within which is reciprocatively captured. An actuating member having a recessed carrier portion at the inside is adapted to loosely enclose the control lever of an electrical toggle switch. A slide knob at the outside is for moving the carrier member together with the toggle switch lever between "on" and "off" positions.

POWIS, JR., GEORGE S.

SAFETY EXTENSION LEVER FOR WALL SWITCH

U.S. Pat. No. 4,454,401

A modified wall plate for a standard toggle switch outlet is equipped with an arm or lever adapted to slide on the plate. The arm or lever is provided with a hollowed protuberance extending outwardly from the front face of the arm and arranged to receive and enclose the actuating finger of a standard toggle switch when the modified wall plate is attached at an existing wall outlet for the switch. The arm or lever is equipped with a detachable rod extending to a substantial distance below the bottom of the wall plate to a level within reach of a small child, thus enabled to safely operate the switch.

MONGEAU, FRANCOIS

EXTERIOR COVER FOR AN ELECTRICAL SOCKET OR SWITCH

U.S. Pat. No. 4,914,265

New cover assemblies for electrical fixtures in buildings allow conventional outlet and (toggle) light switches to be cheaply converted into a variety of different color designs and/or colors without changing the electrical infrastructure of the fixture. The cover assemblies comprise a cover plate with an appropriate number of orifices, each orifice being covered by a slider, so that the whole cover assembly shields the conventional parts of the fixtures normally visible in building interiors.

CONNER, GLENN C.

RAPOZA, MARTIN J.

PERRY, SCOTT M.

SWITCH EXTENDER APPARATUS

U.S. Pat. No. 5,577,602

A switch extender for electrical switches having a front plate slideably coupled to a back plate which in turn is attached to a wall-mounted switch plate. The back plate includes a knock-out portion which allows use of the invention with both toggle switches and rocker switches. A pair of cylindrical bars are positioned within an opening in the front plate. A toggle switch fits within a slot between the bars, and the corners of a rocker switch fit within slots outside of the bars on the front plate. Sliding the front plate relative to the back plate actuates the switch.

SUMMARY OF THE INVENTION

A primary object of the present invention is to provide a light switch extender that will overcome the shortcomings of the prior art devices.

Another object is to provide a light switch extender that is attached in a sliding manner to a switch plate, so that a small child can safely and conveniently operate the lever of a light switch.

An additional object is to provide a light switch extender which has dual mounting positions to allow an additional length to be added thereto for the child's reach, whereby it can be used in a bedroom, bathroom, or any other room a child might want to go in.

A further object is to provide a light switch extender that is simple and easy to use.

A still further object is to provide a light switch extender that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view of the wall switch in the junction box in the wall, the switch plate in place in phantom and the slot head screws with shoulder washers exploded therefrom.

FIG. 3*a* is an enlarged elevational view of one of the slot head screw and shoulder washer taken in the direction of arrow 3*a* in FIG. 3.

FIG. 4 is a perspective view of the inner actuating arm with parts broken away connected in a sliding manner to the wall switch.

Figure 1:
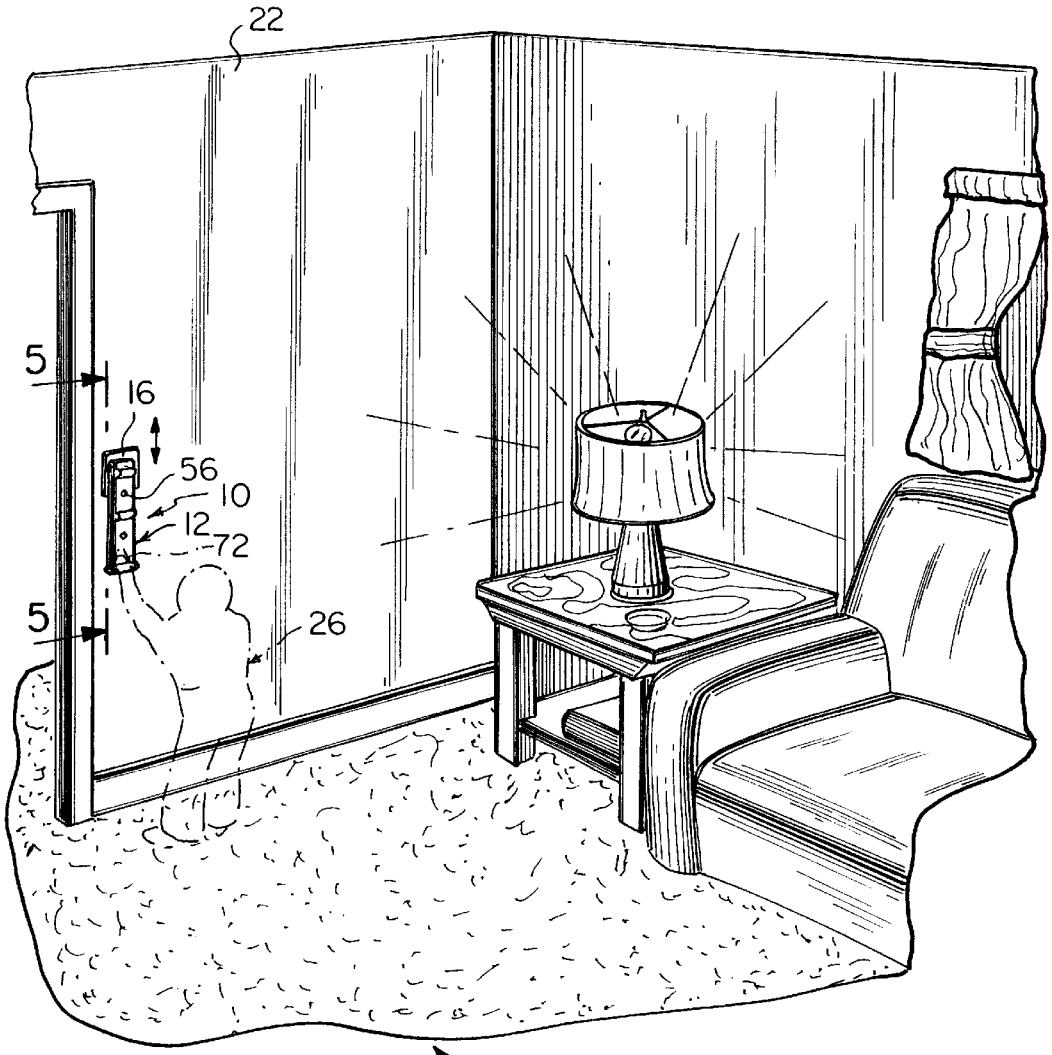
FIG. 1 is a perspective view of a portion of a room in a building with the present invention installed in place and in use by a small child, shown in phantom.
Figure 2:
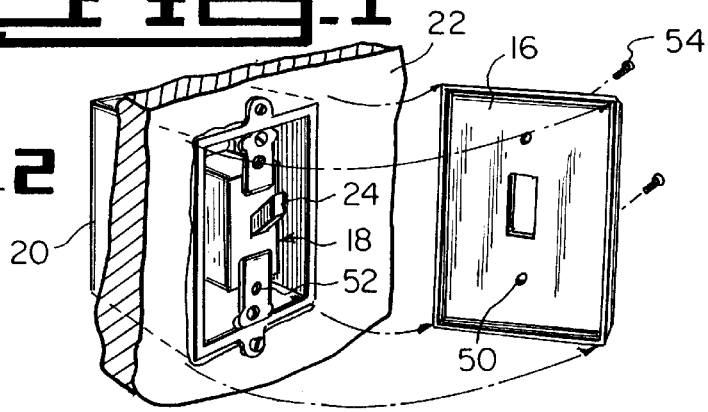
FIG. 2 is a perspective view of the wall switch in a junction box in the wall with the switch plate and mounting screws exploded therefrom.

FIG. 5 is an enlarged cross sectional view taken along line 5—5 in FIG. 1, with parts broken away.

Figures 6, 7, 8, 9:
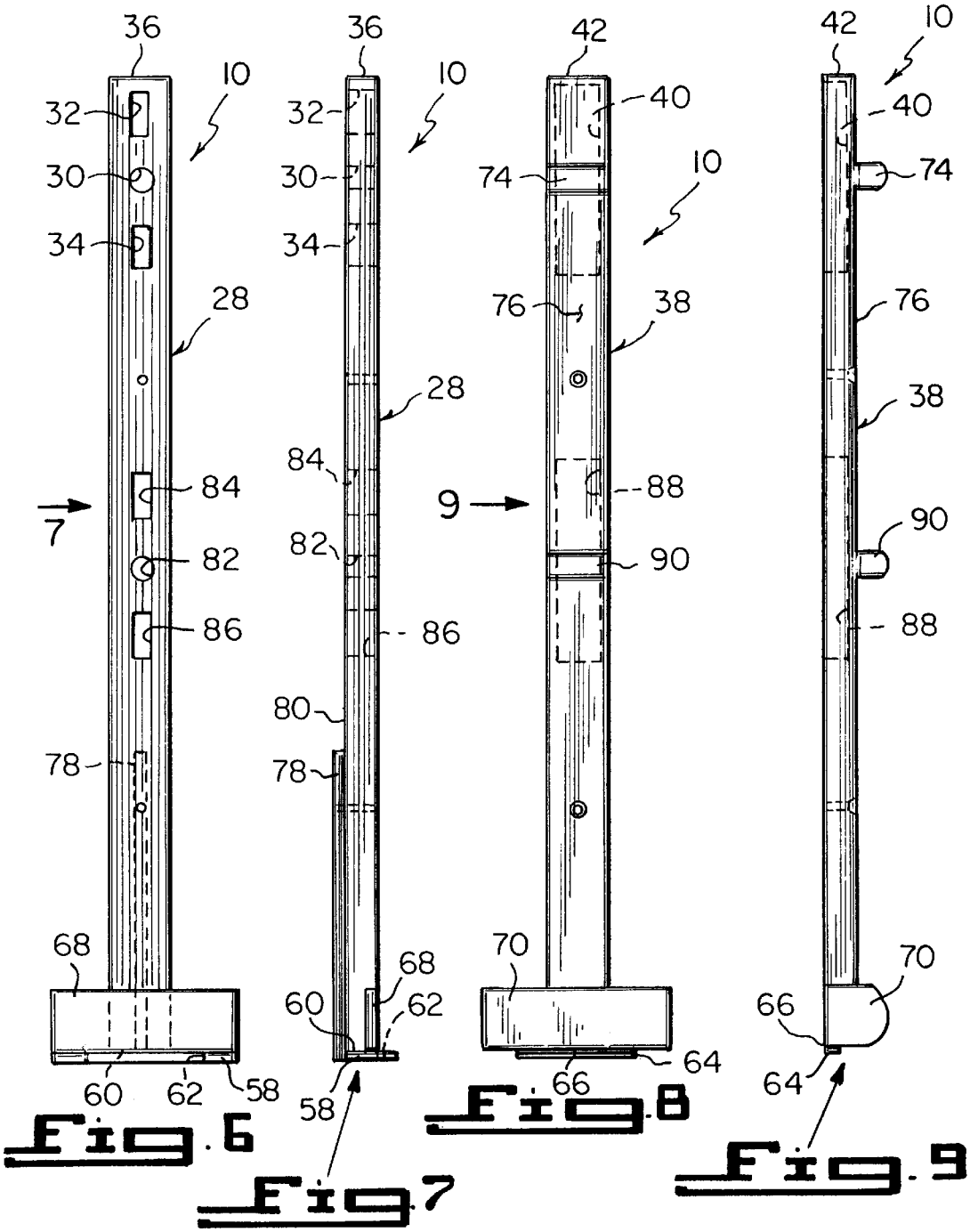

FIG. 6 is a front elevational view of the inner actuating arm.

FIG. 7 is a side elevational view of the inner actuating arm taken in the direction of arrow 7 in FIG. 6.

FIG. 8 is a front elevational view of the outer actuating arm.

FIG. 9 is a side elevational view of the outer actuating arm taken in the direction of arrow 9 in FIG. 8.

Figure 10:
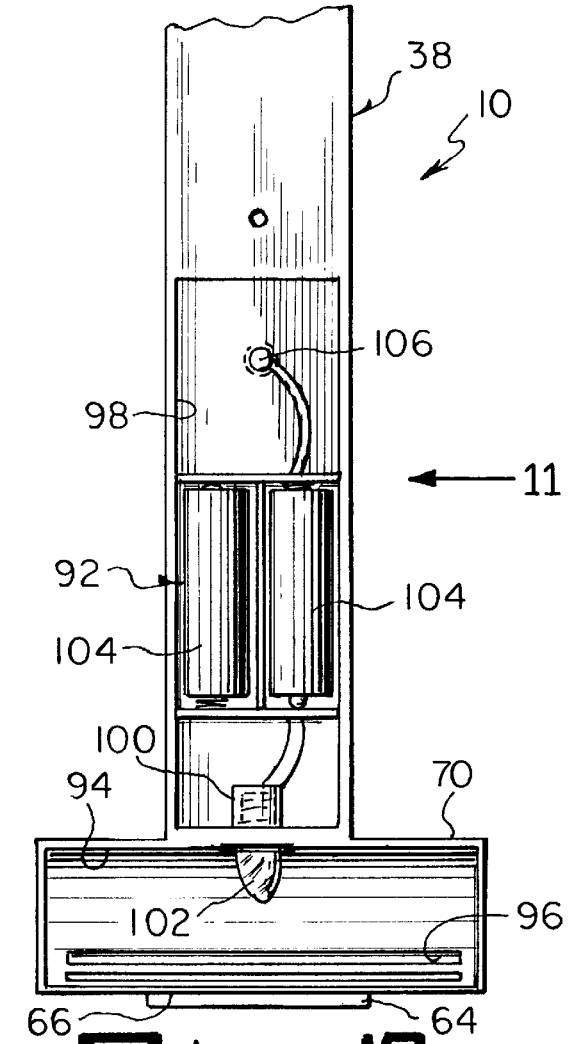

FIG. 10 is a rear elevational view of a modified outer actuating arm with parts broken away, showing a built-in lighting unit therein.

Figure 11:
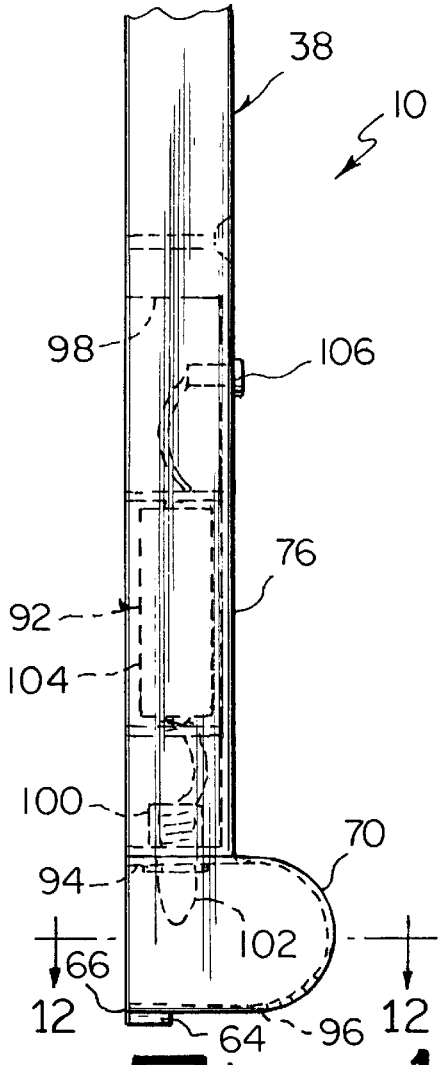

FIG. 11 is a side elevational view taken in the direction of arrow 11 in FIG. 10.

Figure 12:
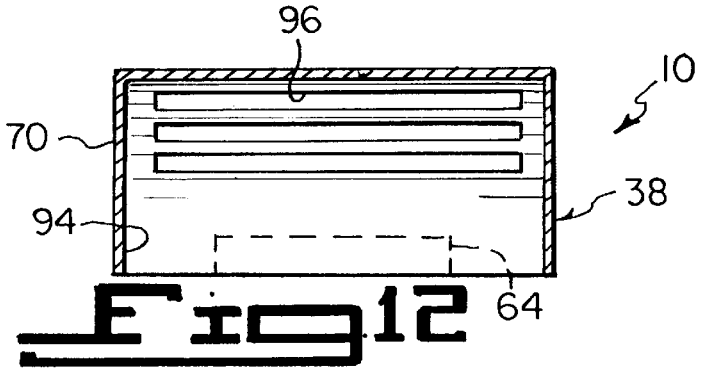

FIG. 12 is a cross sectional view taken along line 12—12 in FIG. 11.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 12 illustrate the present invention being a light switch extender 10. With regard to the reference numerals used, the following numbering is used throughout the various drawing figures.

| | |
|---|---|
| 10 | light switch extender |
| 12 | elongate actuator of 10 |
| 14 | vertically mounting assembly of 10 |
| 16 | switch plate of 18 |
| 18 | light switch in 20 |
| 20 | junction box in 22 |
| 22 | wall |
| 24 | lever of 18 |
| 26 | small child |
| 28 | inner actuating arm of 12 |
| 30 | aperture in 28 |
| 32 | vertical slot in 28 |
| 34 | vertical slot in 28 |
| 36 | upper end of 28 |
| 38 | outer actuating arm of 12 |
| 40 | rear recess in 38 |
| 42 | upper end of 38 |
| 44 | attaching facility of 12 |
| 46 | slot head screw of 14 |
| 48 | shoulder washer of 14 |
| 50 | hole in 16 |
| 52 | hole in 18 |
| 54 | switch plate screw |
| 56 | mounting screw of 44 |
| 58 | flange on 28 |
| 60 | lower end of 28 |
| 62 | slot in 58 |
| 64 | tongue on 38 |

-continued

| | |
|---|---|
| 66 | lower end of 38 |
| 68 | T-shaped handle plate of 28 |
| 70 | T-shaped handle projection of 38 |
| 72 | hand of 26 |
| 74 | finger projection on 76 |
| 76 | front surface of 38 |
| 78 | guide rib on 80 |
| 80 | rear surface of 28 |
| 82 | second aperture in 28 |
| 84 | vertical slot in 28 |
| 86 | vertical slot in 28 |
| 88 | second rear recess in 38 |
| 90 | second finger projection |
| 92 | built-in lighting unit in 38 |
| 94 | rear compartment in 70 |
| 96 | narrow opening in 94 |
| 98 | rear chamber in 38 |
| 100 | light socket of 92 between 94 and 98 |
| 102 | light bulb in 100 |
| 104 | battery of 92 in 98 |
| 106 | photo electric eye of 92 in 98 |

The light switch extender 10 comprises an elongate actuator 12. An assembly 14 is for vertically mounting the elongate actuator 12 in a sliding manner to a switch plate 16 of a light switch 18 located in a junction box 20 in a wall 22. The elongate actuator 12 engages a lever 24 of the light switch 18 extends downwardly therefrom. A small child 26 who normally cannot reach the lever 24 of the light switch 18 can now operate the lever 24 of the light switch 18 between an on and off position, by sliding the elongate actuator 12 up and down.

The elongate actuator 12 includes an inner actuating arm 28 having an aperture 30 and a pair of vertical slots 32, 34, which are located above and below the aperture 30 adjacent an upper end 36, whereby the lever 24 of the light switch 18 extends into the aperture 30. An outer actuating arm 38 has a rear recess 40 therein adjacent an upper end 42 to extend over and cover the aperture 30 and the pair of vertical slots 32, 34 of the inner actuating arm 28. A facility 44 is for attaching the outer actuating arm 38 to the inner actuating arm 28.

The vertically mounting assembly 14 consists of a pair of slot head screws 46 and a pair of shoulder washers 48. The slot head screws 46 with the shoulder washers 48 are inserted through holes 50 in the switch plate 16, threaded into holes 52 in the light switch 18 after the switch plate screws 54 are removed. The slot head screws 46 are backed off until heads of the slot head screws 46 are in a vertical position to allow the pair of vertical slots 32, 34 in the inner actuating arm 28 to fit over the heads of the slot head screws 46. The heads of the slot head screws 46 can be turned a quarter turn clockwise until the heads are horizontal in a retained position.

The attaching facility 44 consists of a pair of mounting screws 56, which are threaded through the outer actuating arm 38 and into the inner actuating arm 28. The inner actuating arm 28 has a right angle flange 58 at a lower end 60 with a slot 62 therethrough. The outer actuating arm 38 has a tongue 64 extending downwardly at a lower end 66, which is inserted into the slot 62 in the flange 58 before the mounting screws 56 are utilized.

The inner actuating arm 28 has a T-shaped handle plate 68 at the lower end 60 above the flange 58. The outer actuating arm 38 has a T-shaped handle projection 70 at the lower end 66 above the tongue 64. When the outer actuating arm 38 is attached to the inner actuating arm 28, the combination of the T-shaped handle plate 68 and the T-shaped handle projection 70 can be grasped by a hand 72 of the small child 26 to operate the lever 24 of the light switch 18.

A finger projection 74 is horizontally formed on a front surface 76 of the outer actuating arm 38 adjacent the upper end 42, so that an adult person can engage the finger projection 74 to operate the lever 24 of the light switch 18. A guide rib 78 is vertically formed on a rear surface 80 of the inner actuating arm 28 adjacent the lower end 60, so that the guide rib 78 can ride against the wall 22 when the lever 24 of the light switch 18 is being operated.

The light switch extender 10 further includes the inner actuating arm 28 having a second aperture 82 and a second pair of vertical slots 84, 86, which are located above and below the second aperture 82 approximately midway. The lever 24 of the light switch 18 can extend into the second aperture 82, while the second pair of vertical slots 84, 86 can fit over the heads of the slot head screws 46. The outer actuating arm 38 has a second rear recess 88 therein approximately midway to extend over and cover the second aperture 82 and the second pair of vertical slots 84, 86 of the inner actuating arm 28. When the attaching facility 44 connects the outer actuating arm 38 to the inner actuating arm 28, the length of the light switch extender 10 will be shortened for a taller child. A second finger projection 90 is horizontally formed on the front surface 76 of the outer actuating arm 38 approximately midway, so that an adult person can engage the second finger projection 90 to operate the lever 24 of the light switch 18.

As shown in FIGS. 10 through 12, the light switch extender 10 can further include a built-in lighting unit 92 in the outer actuating arm 38 above the T-shaped handle projection 70 for illumination in a darkened room. The built in lighting unit 92 consists of the outer actuating arm 38 having a rear compartment 94 in the T-shaped handle projection 70 with a plurality of narrow openings 96 along the bottom thereof. A rear chamber 98 extends above the rear compartment 94. A light socket 100 is mounted vertically between the rear compartment 94 and the rear chamber 98. A light bulb 102 in the light socket 100 extends into the rear compartment 94.

A pair of batteries 104 in the rear chamber 98 are electrically connected to the light socket 100. A photo electric eye 106 in the rear chamber 98 extends outwardly through the front surface 76 of the outer actuating arm 38 and is electrically connected to the batteries 104. The photo electric eye 106 being sensitive to motion, will cause the light bulb 102 to turn on and radiate light downward through the narrow openings 96 in the rear compartment 94.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A light switch extender comprising:

an elongate actuator including:

i) an inner actuating arm having an aperture and a pair of vertical slots, which are located above and below said aperture adjacent an upper end, whereby the lever of the light switch extends into said aperture;

ii) an outer actuating arm having a rear recess therein adjacent an upper end to extend over and cover said aperture and said pair of vertical slots of said inner actuating arm; and iii) means for attaching said outer actuating arm to said inner actuating arm, said attaching means including a pair of mounting screws which are threaded through said outer actuating arm and into said inner actuating arm, wherein said inner actuating arm having a right angle flange at a lower end with a slot therethrough; and said outer actuating arm having a tongue extending downwardly at a lower end which is inserted into said slot in said flange before said mounting screws are utilized; and b) means for vertically mounting said elongate actuator in a sliding manner to a switch plate of a light switch located in a junction box in a wall, said elongate actuator engages a lever of the light switch and extends downwardly therefrom, so that a small child who normally cannot reach the lever of the light switch can now operate the lever of the light switch between an on and off position, by sliding said elongate actuator up and down.

2. A light switch extender as recited in claim 1, wherein said vertically mounting means includes:

a) a pair of slot head screws; and b) a pair of shoulder washers, whereby said slot head screws with said shoulder washers are inserted through holes in the switch plate, threaded into holes in the light switch after the switch plate screws are removed, said slot head screws are backed off until heads of said slot head screws are in a vertical position to allow said pair of vertical slots in said inner actuating arm to fit over the heads of said slot head screws, so that the heads of said slot head screws can be turned a quarter turn clockwise until the heads are horizontal in a retained position.

3. A light switch extender as recited in claim 1, further including:

a) said inner actuating arm having a T-shaped handle plate at the lower end above said flange; and b) said outer actuating arm having a T-shaped handle projection at the lower end above said tongue, so that when said outer actuating arm is attached to said inner actuating arm the combination of said T-shaped handle plate and said T-shaped handle projection can be grasped by a hand of the small child to operate the lever of the light switch.

4. A light switch extender as recited in claim 1, further including a finger projection horizontally formed on a front surface of said outer actuating arm adjacent the upper end, so that an adult person can engage said finger projection to operate the lever of the light switch.

5. A light switch extender as recited in claim 1, further including a guide rib vertically formed on a rear surface of said inner actuating arm adjacent the lower end, so that said guide rib can ride against the wall when the lever of the light switch is being operated.

6. A light switch extender as recited in claim 2, further including:

a) said inner actuating arm having a second aperture and a second pair of vertical slots, which are located above and below said second aperture approximately midway, whereby the lever of the light switch can extend into said second aperture, while said second pair of vertical slots can fit over the heads of said slot head screws; and b) said outer actuating arm having a second rear recess therein approximately midway to extend over and cover said second aperture and said second pair of vertical slots of said inner actuating arm, so that when said attaching means connects said outer actuating arm to said inner actuating arm, the length of said light switch extender will be shortened for a taller child.

7. A light switch extender as recited in claim 6, further including a second finger projection horizontally formed on a front surface of said outer actuating arm approximately midway, so that an adult person can engage said second finger projection to operate the lever of the light switch.

8. A light switch extender as recited in claim 3, further including a built-in lighting unit in said outer actuating arm above said T-shaped handle projection for illumination in a darkened room.

9. A light switch extender as recited in claim 8, wherein said built-in lighting unit includes:

a) said outer actuating arm having a rear compartment in said T-shaped handle projection with a plurality of narrow openings along the bottom thereof and a rear chamber extending above said rear compartment;

b) a light socket mounted vertically between said rear compartment and said rear chamber;

c) a light bulb in said light socket extending into said rear compartment;

d) a pair of batteries in said rear chamber electrically connected to said light socket; and e) a photo electric eye in said rear chamber extending outwardly through said front surface of said outer actuating arm and electrically connected to said batteries, so that said photo electric eye sensitive to motion will cause said light bulb to turn on and radiate light downward through said narrow openings in said rear compartment.

10. A light switch extender as recited in claim 2, further including:

a) said inner actuating arm having a T-shaped handle plate at the lower end above said flange; and b) said outer actuating arm having a T-shaped handle projection at the lower end above said tongue, so that when said outer actuating arm is attached to said inner actuating arm the combination of said T-shaped handle plate and said T-shaped handle projection can be grasped by a hand of the small child to operate the lever of the light switch.

11. A light switch extender as recited in claim 10, further including a finger projection horizontally formed on a front surface of said outer actuating arm adjacent the upper end, so that an adult person can engage said finger projection to operate the lever of the light switch.

12. A light switch extender as recited in claim 11, further including a guide rib vertically formed on a rear surface of said inner actuating arm adjacent the lower end, so that said guide rib can ride against the wall when the lever of the light switch is being operated.

13. A light switch extender as recited in claim 12, further including:

a) said inner actuating arm having a second aperture and a second pair of vertical slots, which are located above and below said second aperture approximately midway, whereby the lever of the light switch can extend into said second aperture, while said second pair of vertical slots can fit over the heads of said slot head screws; and b) said outer actuating arm having a second rear recess therein approximately midway to extend over and cover said second aperture and said second pair of vertical slots of said inner actuating arm, so that when said attaching means connects said outer actuating arm to said inner actuating arm, the length of said light switch extender will be shortened for a taller child.

14. A light switch extender as recited in claim 13, further including a second finger projection horizontally formed on a front surface of said outer actuating arm approximately midway, so that an adult person can engage said second finger projection to operate the lever of the light switch.

15. A light switch extender as recited in claim 14, further including a built-in lighting unit in said outer actuating arm above said T-shaped handle projection for illumination in a darkened room.

16. A light switch extender as recited in claim. 15, wherein said built-in lighting unit includes:

a) said outer actuating arm having a rear compartment in said T-shaped handle projection with a plurality of narrow openings along the bottom thereof and a rear chamber extending above said rear compartment;

b) a light socket mounted vertically between said rear compartment and said rear chamber;

c) a light bulb in said light socket extending into said rear compartment;

d) a pair of batteries in said rear chamber electrically connected to said light socket; and e) a photo electric eye in said rear chamber extending outwardly through said front surface of said outer actuating arm and electrically connected to said batteries, so that said photo electric eye sensitive to motion will cause said light bulb to turn on and radiate light downward through said narrow openings in said rear compartment.

* * * * *